US005718344A

United States Patent [19]

Joldeson et al.

[11] Patent Number: 5,718,344

[45] Date of Patent: Feb. 17, 1998

[54] KNOCK-DOWN GARMENT RACKS

[76] Inventors: George Robert Joldeson; Ecatarina Joldeson, both of 95-22A 107th St., Ozone Park, N.Y. 11416

[21] Appl. No.: 684,096

[22] Filed: Jul. 22, 1996

[51] Int. Cl.[6] ..... A47F 5/00

[52] U.S. Cl. ..... 211/206; 211/182; 248/165

[58] Field of Search ..... 211/206, 204, 211/182, 189, 123; 248/165

[56] References Cited

U.S. PATENT DOCUMENTS

| | | | |
|---|---|---|---|
| 1,008,477 | 11/1911 | Kohn | 211/204 |
| 2,065,902 | 12/1936 | Levin | 211/204 X |
| 2,893,568 | 7/1959 | Scholz | 211/204 |
| 3,146,892 | 9/1964 | White | 211/204 |
| 3,503,525 | 3/1970 | Loebner | 211/206 |
| 3,705,731 | 12/1972 | Berchak | 280/79.11 X |
| 5,617,962 | 4/1997 | Chen | 211/206 |

*Primary Examiner*—Robert W. Gibson, Jr.
*Attorney, Agent, or Firm*—Nathaniel Altman

[57] ABSTRACT

The rectangular tubular frame of the garment rack is mounted on two heavy-duty rectangular tubular support bases, carrying casters at either end of each, by a clamp-adaptor surrounding the central portion of each support base and providing an upwardly-projecting cylindrical boss on each for positioning the garment rack tubular frame thereon. Each vertical support post of the tubular frame has an inwardly-facing horizontally disposed adaptor attached reinforcedly thereto, the outer end of each adaptor being concavely shaped to follow the contour of the post on which it is perpendicularly mounted, and the two adaptors serve to support the horizontal garment hanger support rod of the rack frame.

10 Claims, 3 Drawing Sheets

KNOCK-DOWN GARMENT RACKS

FIELD OF THE INVENTION

This invention is directed to the provision of knock-down garment racks, most especially of sturdy, stable and durable racks for industrial use.

BACKGROUND OF THE INVENTION

The garment racks in current general industrial use are largely assemblies of steel pipes connected by typical plumbing joints or by welding. For the most part, these racks have little or no reinforcement and, when given the extraordinary hard wear and abuse of being pushed or pulled along bumpy streets, up and down curbs, etc., their useful life is shortened considerably. As for collapsible racks, those few that are found in use or in the prior art, having pivotally-mounted supports or knuckle joints for their collapsibility, lack the durability to be suitable for sustained hard usage.

It is therefore a primary object of this invention to provide a knock-down garment rack of outstanding strength, durability and high resistance to excessive wear. It is also an object of this invention to provide a garment rack which can be disassembled for space-saving storage and shipping, and reassembled quickly with a minimum of time, effort or tools.

A search of the prior art has uncovered the following patents which may have some pertinence to the present invention:

U.S. Pat. No. 1,008,477, issued to Kohn on Nov. 11, 1911;

U.S. Pat. No. 2,748,955, issued to Anselmo on Jun. 5, 1956;

U.S. Pat. No. 2,798,618, issued to Singer on Jul. 9, 1957;

U.S. Pat. No. 2,893,568, issued to Scholz on Jul. 7, 1959;

U.S. Pat. No. 3,146,892, issued to White on Sep. 1, 1964;

U.S. Pat. No. 3,705,731, issued to Berchak on Dec. 12, 1997;

British Patent No. 289,366, issued on Jan. 26, 1928;

British Patent No. 389,890, issued on Jun. 9, 1932.

Kohn teaches a folding rack that has vertical standards that fit within a coaxial support; Scholz teaches a knock-down rack that has square tubing as the bases onto which the vertical supports each are held by a base locking member; White teaches a knockdown wheeled support rack with square tubing to support the vertical legs and wheels; British patents teach the concept of expanding bushings to hold the joints secure in tubular racks; and Anselmo, Singer and Berchak are representative of the state of the art.

SUMMARY OF THE INVENTION

The present invention, while similar in general outline to conventional garment racks, provides novel strength- and durability-enhancing elements well beyond the disclosures of the prior art cited above. Two horizontal support base members, rectangular in cross-section, formed from heavy-duty steel and each having a caster depending from either end thereof, serve to carry and anchor the rack's rectangular frame by means of a centrally positioned strong two-jawed inter-locking clamp-adaptor mounted on and through each base member. Each clamp-adaptor's upper jaw has an upwardly projecting cylindrical boss onto which the vertical portions of an H-shaped tubular transverse rack-bracing element are fittingly fixed. The lower ends of the rectangular rack frame's vertical tubular posts are inserted coaxially and secured in the upwardly-facing portions of the H-shaped brace.

At the upper ends of the vertical tubular rack posts, the horizontal garment hanger upper support rod is mounted at each end on an adaptor, the outer end of which is concavely shaped to engage and to be fastened to the circumferential surface of an upward extension of each vertical post for rigid, strong joints.

All the features of this invention and its preferred embodiments will be described in full detail in connection with the following illustrative, but not limiting, drawings, wherein:

SHORT FIGURE DESCRIPTION OF THE DRAWINGS

DESCRIPTION OF THE PREFERRED EMBODIMENTS

Figures 1, 3:
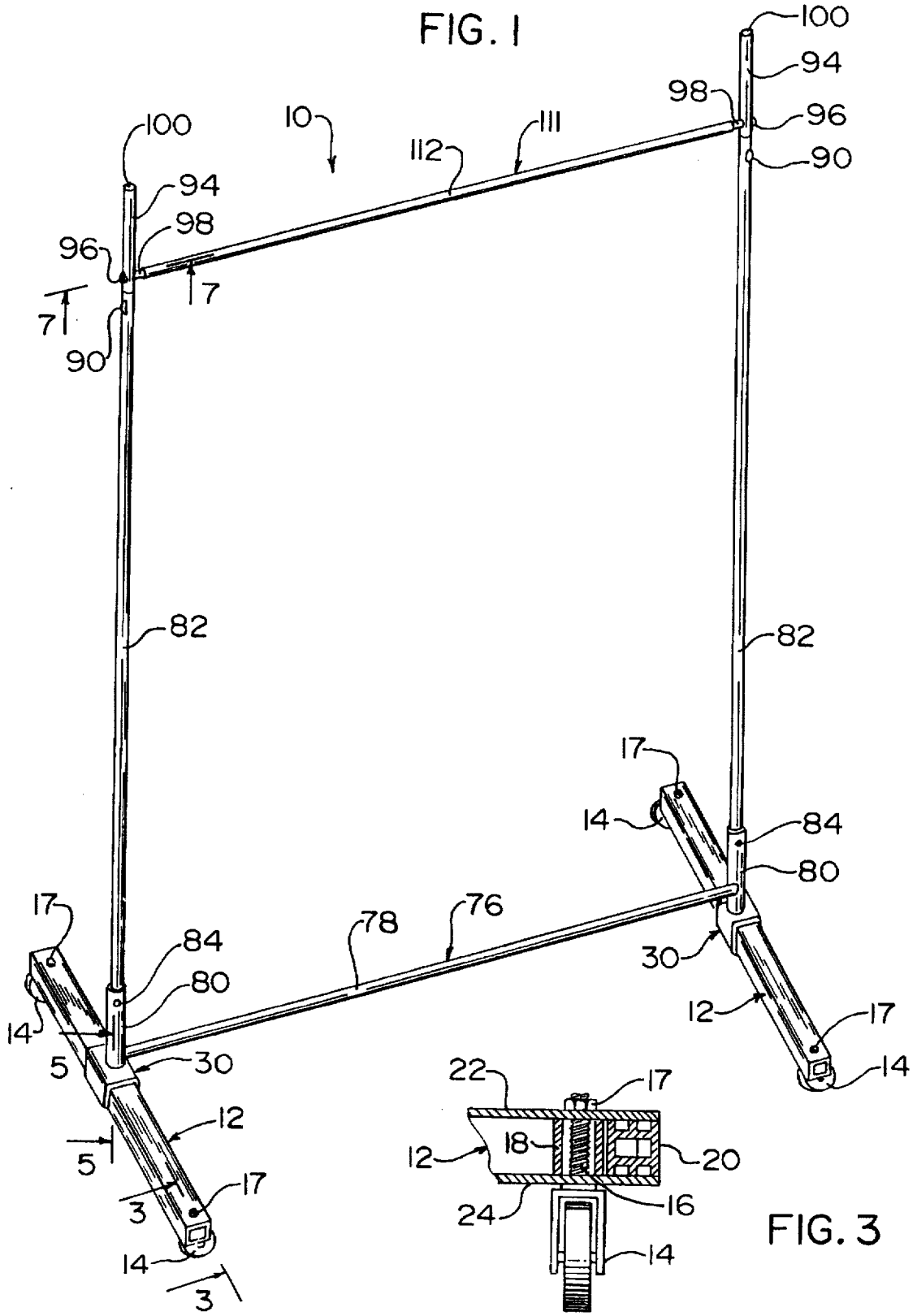
FIG. 1 is a left front perspective view of a garment rack made in accordance with this invention.
FIG. 3 is a sectional view taken along line 3—3 of FIG. 1.

The knock-down garment rack shown in FIG. 1, generally designated 10, is mounted on a pair of sturdy tubular support bases 12, rectangular with rounded edges in cross-section. Each support base 12 carries a caster 14 adjacent either end thereof; as seen in FIG. 3, spindle 16 of each caster 14 is secured vertically through base 12 by nut 17, with strong steel bushing 18 positioned around each spindle 16 within base 12, to resist damage to, or collapse of, casters 14 or bases 12 from rough usage. Also seen in FIG. 3 is resilient plastic end plug 20, one of which is provided for each base 12 end, serving to seal the interiors of beams 12 from dirt and dust, at the same time acting as a bumper to cushion the effect of a collision therewith.

Figure 4:
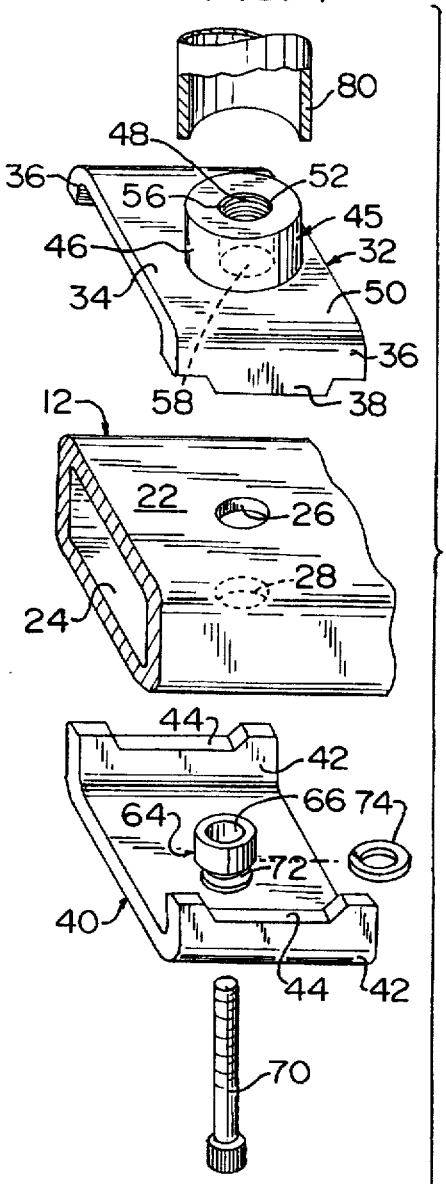
FIG. 4 is an exploded left front perspective view of the base support member (partially shown) and the clamp-adaptor jaw members to be assembled therewith.
Figure 5:
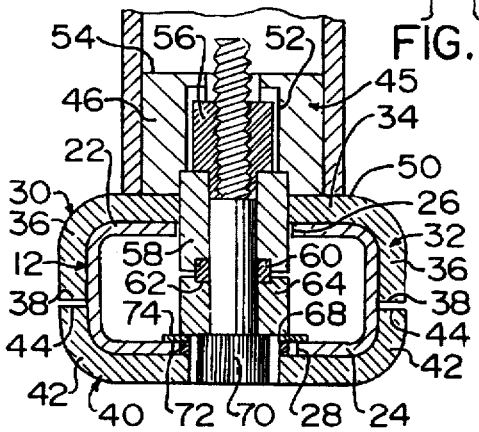
FIG. 5 is an enlarged sectional view taken along line 5—5 of FIG. 1, of the assembled clamp-adaptor elements shown in FIG. 4.

Each support base 12 is centrally bored through its top and bottom horizontal portions 22 and 24, respectively, forming openings 26 and 28 to accept fittingly portions of clamp-adaptor assembly 30 mounted therein. Specifically, as best seen in FIGS. 4 and 5, each heavy-gauge clamp-adaptor 30 has an upper jaw member 32 shaped like an inverted U, with center portion 34 and each of its depending sides 36 extending downwardly as a tapered tongue 38, while lower jaw member 40 is shaped like an upright U whose upwardly projecting sides 42 each has a centrally located tapered groove 44 exactly complementary to and interfitting with the corresponding tongue 38. Each upper jaw member 32 has a cylindrical element 45 welded thereto and comprising boss 46 centrally bored at 48 and extending upwardly from jaw 32's horizontal top surface 50; boss 46 has enlarged hexagonally-shaped opening 52 located directly below its top surface 54 to accommodate non-rotatably loosely confined threaded nut 56 placed and staked therein during original assembly.

As shown, each cylindrical element 45 on upper jaw 32 also has a downwardly projecting centrally bored boss 58 which is concentric with boss 46, extends fittingly through opening 26 in beam 12 and has at its lower end enlarged bore 60 to accommodate O-ring 62 (FIG. 5). From the opposite direction, each lower jaw member 40 has a centrally disposed upwardly projecting boss 64 with its upper bore 66 equal to, aligned and concentric with bore 48, and its lower bore 68 sized to accept the head of Allen bolt 70, boss 64 extending through opening 28 of beam 12 to a position directly under boss 58. Boss 64 has an undercut groove 72 directly above the inner surface of lower jaw member 40 (FIG. 4), where lock washer 74 (shown detached for clarity) may be placed during assembly so that each beam 12, lower jaw 40 and Allen bolt 70 may remain connected when garment rack 10 is disassembled.

In assembling each clamp-adaptor 30 with its corresponding support beam 12, lower jaw 40 is placed appropriately on beam 12 with boss 64 projecting through opening 28; lock washer 74 is positioned and snapped into place on undercut groove 72 by manipulation through upper beam opening 26. Upper jaw member 32 is put into place and Allen bolt 70 is inserted from the bottom of the assembly; as bolt 70 is turned, it engages the threads of captive nut 56 and its outer surface presses O-ring 62; as bolt 70 reaches its ultimate tightness, upper and lower jaws 32 and 40 substantially meet in interlocking engagement, while bosses 58 and 64 are kept from actual contact only by the protruding portion of resilient O-ring 62. As a result, the two clamp-adaptors 30 are mounted with unusual strength and firmness on their respective support bases 12, and their upwardly projecting bosses 46 provide a foundation of great stability for the rectangular frame of garment rack 10 mounted thereon.

H-shaped tubular support 76 has its cross-bracing horizontal portion 78 terminating at each end with welded vertical tubes 80. the lower ends of which fit concentrically over, are supported by, and are welded to, corresponding projecting bosses 46 of clamp-adaptors 30. The lower ends of vertical rack support posts 82 are held releasably within tubes 80 of H-shaped support 76 by conventional spring-pressed detents 84 which engage matching openings 86 in tubes 80, seen in FIG. 2.

It should be noted that while the drawings and description above show each clamp-adaptor assembly 30 has upper jaw member 32, cylindrical element 45 with bosses 46 and 58, and vertical tubes 80 as individual components welded together, it is contemplated that in the future they may be cast into a single unitary piece; in exactly analogous manner, lower jaw member 40 and boss 64 may also be cast as one piece.

Figure 2:
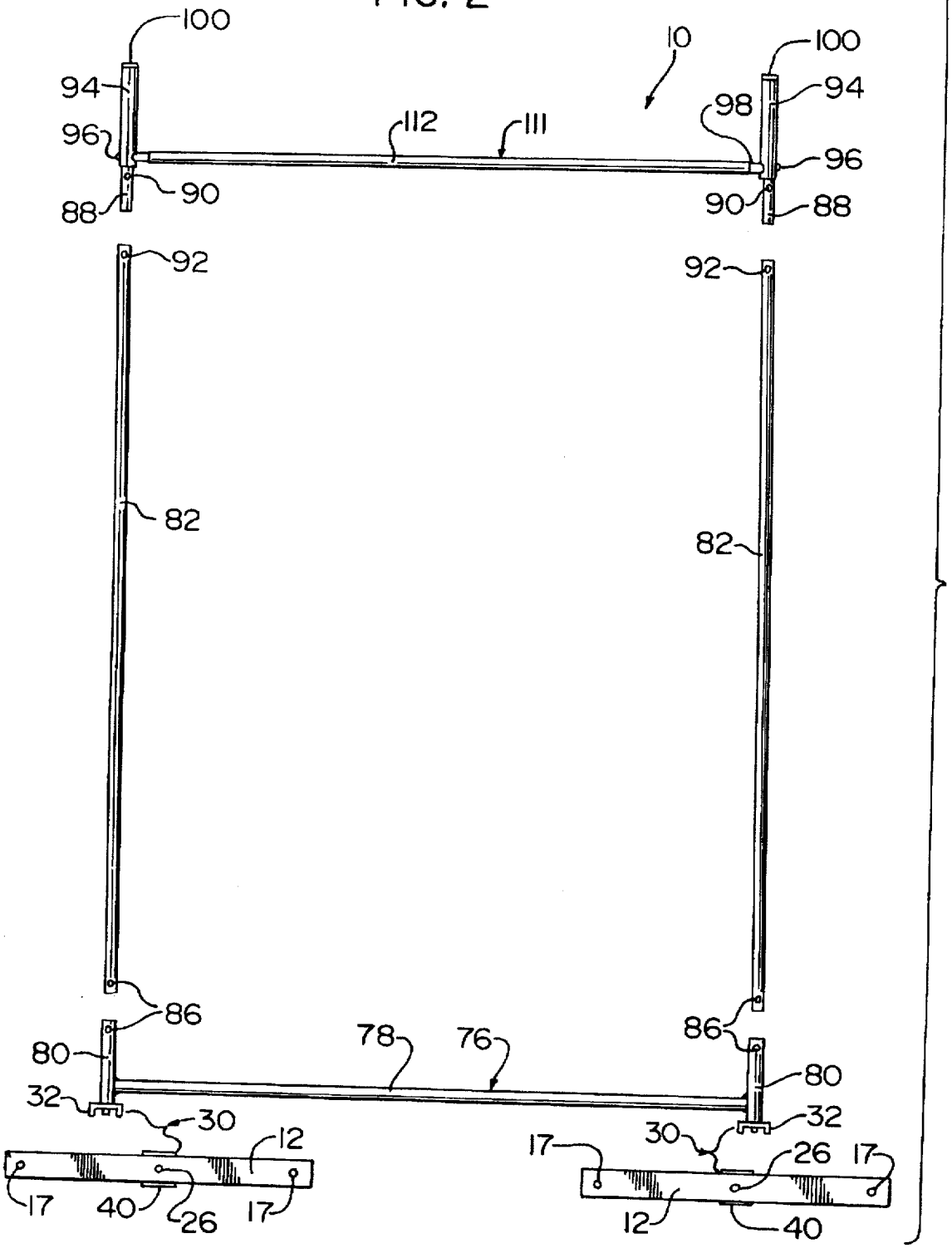
FIG. 2 is an exploded plan view of the disassembled parts of the garment rack of FIG. 1.
Figure 6:
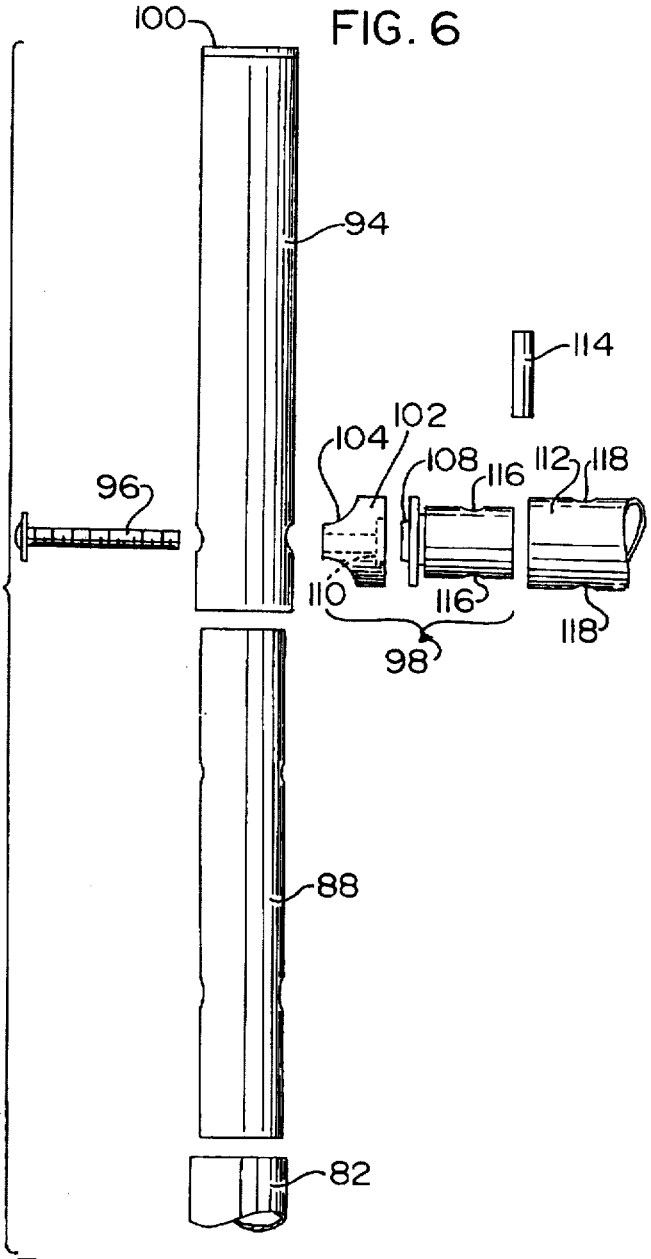
FIG. 6 is an exploded front elevational view of the connecting elements used to form the rigid joint between the left vertical post and the horizontal hanger support bar of the garment rack.
Figure 7:
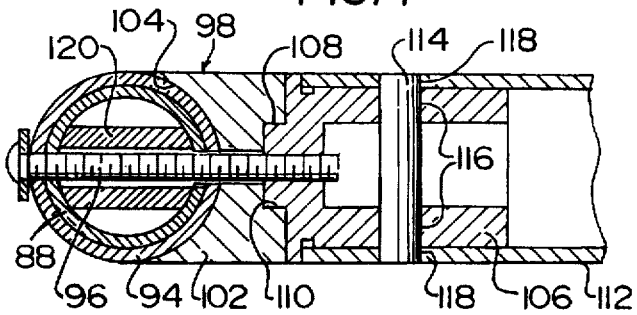
FIG. 7 is an enlarged sectional view, taken along line 7—7 of FIG. 1, of the assembled connector elements shown in FIG. 6.

At the upper end of each vertical rack post 82, an inner concentric sleeve 88 is releasably held therein by detent 90 protruding through opening 92 in post 82 (FIG. 2). Sleeve 88 extends upwardly and is connected with vertical rack post extension 94 by screw 96 passing transversely through both and securing adaptor 98 fittingly to the outer contour of post extension 94 (FIGS. 6 and 7). Sealing caps 100 may be provided at the tops of post extensions 94. As best seen in FIG. 7, each adaptor 98 consists of outer piece 102, concavely shaped at its outer end 104 to match the contour of post extension 94, and adaptor extension 106 having cylindrical projection 108 which fits rotatably in bore 110 of piece 102. When screw 96 has been tightened in the assembly of rack 10, a strong rigid joint is created. Each end of horizontal tubular garment hanger support rod 112 has been slid onto the corresponding inwardly facing end of adaptor extension 106 and is secured in place by the insertion of split spring pin 114 into aligned openings 116 in extension 106 and corresponding openings 118 in hanger support rod 112 to complete the assembly of rack 10.

Also shown in FIG. 7 is heavy metal bushing 120 around screw 96, the ends of bushing 120 being curved to conform to the interior surface of sleeve 88, to enhance the strength and resistance of the joint and its components to damage, bending or collapse. Bushing 120 in FIG. 7 and bushing 18 of FIG. 3 are typical of reinforcing elements incorporated wherever possible throughout rack 10's structure.

The disassembly of rack 10 for transport or storage can be actually accomplished with just an Allen wrench by: manually disengaging detents 84 and 90, thus releasing vertical rack posts 82 and upper assembly 111 of garment hanger support rod 112, adaptor 98, post extension 94 and sleeve 88 (as shown in FIG. 2); after loosening bolts 70, H-shaped support 76, together with upper laws 32 welded thereto, may be lifted off, leaving support beams 12, casters 14, lower jaw 40 held in place by lock washer 74 and Allen bolt 70 assembled, bolt 70 being held by O-ring 62. Only a few minutes are required to accomplish this; if it is desired to disassemble the upper and lower assemblies further, a screwdriver is required for the former, the Allen wrench for the latter. It may be noted also that because of rack 10's easy disassembly, rarely required replacement of a damaged or broken part is a simple matter.

The sturdiness and strength of garment racks constructed in accordance with the concepts and principles of this invention are outstanding. Testing has established that these racks are capable of successfully supporting loads of more than two hundred pounds without difficulty or damage. Another feature to be mentioned is that the garment racks of this invention may be provided with conventional and known shallow wire baskets extending across the width of the racks to carry non-hanging items, for installation above either H-shaped support 76 or garment hanger support rod 112.

A complete disclosure of the details and essence of this invention has been made, and the best modes of practicing it as now contemplated have been presented. It will be apparent to all skilled in the art that modifications, substitutions and additions may be made in the elements of the invention without departing from its concepts, the scope of which is defined and limited only by the ensuing claims, wherein:

What is claimed is:

1. A knock-down garment rack, which comprises:

a pair of support base members, each said base member being of tubular rectangular cross-sectional configuration and having a caster mounted rotatably adjacent each end thereof and depending therefrom;

clamp-adaptor means centrally positioned on each said base member, each said clamp-adaptor means comprising an upper and lower jaw secured together around each said base member, each said upper jaw having a centrally disposed cylindrical boss extending upwardly therefrom; and a rectangular garment rack frame mounted on said clamp-adaptor means secured on said support base members, comprising:

an H-shaped tubular support brace, the horizontal portion of said brace extending across and defining the width of the knock-down garment rack, the vertical end portions of said brace each being dimensioned to be mounted fittingly and welded on said upwardly-extending cylindrical boss of each said clamp-adaptor upper jaw;

a pair of vertical tubular support posts serving as the uprights of said rectangular rack frame, the lower end of each said support post being concentrically and releasably secured in the top section of one said vertical end portion of said H-brace;

inwardly-facing adaptor means fittingly mounted adjacent the top of and perpendicular to each said vertical support post; and horizontally disposed tubular garment hanger support rod releasably secured on said inwardly-facing adaptor means at each end, thus completing said rectangular garment rack frame.

2. The knock-down garment rack as defined in claim 1, wherein said pair of support base members have their rectangular contours rounded at all edges and said jaws of said clamp-adaptor means each are shaped to conform closely thereto.

3. The knock-down garment rack as defined in claim 2, wherein said clamp-adaptor means further comprises:

each said upper jaw member being shaped substantially like an inverted U with said upwardly-extending cylindrical boss positioned centrally on said upper jaw's horizontal portion and a second cylindrical boss extending downwardly, both said upper jaw bosses and said horizontal portion having a common central bore, the upper portion of said bore in said upper boss being enlarged and hexagonally shaped to accommodate unrotatably a threaded nut, the lowest portion of said bore in said second boss being enlarged to accommodate fittingly a resilient O-ring;

each said lower jaw member being substantially U-shaped with a centrally bored cylindrical boss extending upwardly from said lower jaw's bottom horizontal portion, said lower jaw's bore through said bottom horizontal portion and partly into said cylindrical boss thereon is enlarged; and a threaded bolt for upward insertion through said lower jaw's bore and said upper jaw's bore to engage threadedly with said threaded nut, to be turned and thus to tighten said clamp-adaptor jaws toward each other, said lower jaw's enlarged bore portion permitting said threaded bolt's head to be countersunk.

4. The knock-down garment rack as defined in claim 3, wherein said pair of support beams each has centrally located aligned openings in top and bottom horizontal sections thereof, said openings being dimensioned to receive respectively therein said downwardly-extending cylindrical boss of said upper jaw and said upwardly-extending boss of said lower jaw, whereby, when said clamp-adaptor jaws are installed on each said support beam, the insertion of said threaded bolt and its tightening causes said resilient O-ring to spread and form a seal between the almost-meeting bottom surface of said upper jaw's second boss and the top surface of said lower jaw's boss.

5. The knock-down garment rack as defined in claim 4, further comprising:

a lock washer; and said lower jaw's cylindrical boss having an undercut of reduced outer diameter at its lower end dimensioned to accept said lock washer thereon, whereby, when said lower jaw's boss is introduced into one of said support beams, said lock washer may be snapped into place around said undercut reduced diameter portion of said lower jaw's boss so that said lower jaw is held together with said support beam.

6. The knock-down garment rack as defined in claim 4, wherein the vertical sides of said inverted-U upper jaw and the vertical sides of said U-shaped lower jaw of each said clamp-adaptor are configured so that a portion of each said jaw's vertical side interlocks with said corresponding opposite jaw's vertical side, so that said clamp-adaptor can strongly resist stresses and forces applied thereto without shifting, slipping or being loosened.

7. The knock-down garment rack as defined in claim 6, wherein each said vertical side of said upper law has a centrally located tapered tongue extending downwardly beyond the level of the ends of said vertical sides, and each said vertical side of said lower jaw has a centrally located tapered groove fittingly complementary to said tapered tongue for interlocking therewith when said clamp-adaptor is assembled with, and tightened on, one of said pair of support beams.

8. The knock-down garment rack as defined in claim 1, wherein said inwardly-facing adaptor means each comprise a cylindrical body having the outer end thereof concavely shaped to follow the contour of one of said vertical support posts when said adaptor means is positioned thereon and perpendicular thereto, and a cylindrical extension with a cylindrical projection mounted for full free rotation in a complementary bore on the end of said cylindrical body opposite said concavely-shaped end.

9. The knock-down garment rack as defined in claim 8, wherein said cylindrical body's diameter at its outer end is equal to said tubular garment hanger support rod's outer diameter, said cylindrical extension having a stepped-down diameter at its inner portion equal to said tubular garment hanger support rod's inner diameter, said hanger support rod thereby being fittingly supported when assembled and releasably secured on said cylindrical extension's inner portion by removable fastening means.

10. The knock-down garment rack as defined in claim 8, further comprising:

a tubular sleeve fittingly and releasably secured inside each of said vertical support posts adjacent the upper end thereof and extending upwardly;

a tubular vertical support post extension positioned on each said tubular sleeve, each said extension having a diameter equal to that of said support posts;

a screw passing horizontally and transversely through aligned openings in each said vertical support post extension and each said tubular sleeve, said screw extending into and threadedly engaging the central bore of each said adaptor means' cylindrical body; and a steel bushing surrounding each said screw within said tubular sleeve, the ends of said bushing being rounded to engage the inner surface of each said sleeve and fit tightly therein, thus to provide reinforcement and increased strength to said adaptor means and to the knock-down garment rack assembly.

* * * * *